US010544652B2

(12) United States Patent
Fripp et al.

(10) Patent No.: US 10,544,652 B2
(45) Date of Patent: Jan. 28, 2020

(54) TWO-PART DISSOLVABLE FLOW-PLUG FOR A COMPLETION

(71) Applicant: Halliburton Energy Services, Inc., Houston, TX (US)

(72) Inventors: Michael L. Fripp, Carrollton, TX (US); Zachary Walton, Carrollton, TX (US); Ryan M. Novelen, Grand Prairie, TX (US); Ryan W. McChesney, Prosper, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 187 days.

(21) Appl. No.: 15/567,018

(22) PCT Filed: Jul. 13, 2016

(86) PCT No.: PCT/US2016/042048
§ 371 (c)(1),
(2) Date: Oct. 16, 2017

(87) PCT Pub. No.: WO2018/013101
PCT Pub. Date: Jan. 18, 2018

(65) Prior Publication Data
US 2018/0223624 A1 Aug. 9, 2018

(51) Int. Cl.
*E21B 34/06* (2006.01)
*E21B 43/12* (2006.01)

(52) U.S. Cl.
CPC ..... *E21B 34/063* (2013.01); *E21B 43/12* (2013.01)

(58) Field of Classification Search
CPC ..... E21B 34/063; E21B 34/08; E21B 43/08; E21B 43/12
See application file for complete search history.

(56) References Cited

U.S. PATENT DOCUMENTS

| | | | | |
|---|---|---|---|---|
| 4,285,398 | A * | 8/1981 | Zandmer | E21B 43/11 166/100 |
| 5,310,000 | A | 5/1994 | Arterbury et al. | |
| 7,699,101 | B2 | 4/2010 | Fripp et al. | |
| 9,611,711 | B2 * | 4/2017 | Peterson | E21B 29/02 |

(Continued)

FOREIGN PATENT DOCUMENTS

| | | | |
|---|---|---|---|
| WO | 2015102609 | A1 | 7/2015 |
| WO | 2017135934 | A1 | 8/2017 |

OTHER PUBLICATIONS

Offshore Technology Conference, Degradable Metal for Use in a Fully Dissolvable Frac Plug, OTC-27187-MS, copyright 2016, presented May 2-5, 2016.

(Continued)

*Primary Examiner* — Jennifer H Gay
(74) *Attorney, Agent, or Firm* — McGuireWoods LLP

(57) ABSTRACT

Well systems for plugging and unplugging a flow path in a subterranean formation are provided. An example well system comprises a flow path comprising a two-part dissolvable flow-plug. The two-part dissolvable flow-plug comprises a retaining component and a plugging component adjacent to the retaining component. The retaining component comprises a dissolvable material. The flow path is in fluid communication with a tubing. The retaining component is configured to retain the plugging component in a fixed position.

19 Claims, 5 Drawing Sheets

(56) References Cited

U.S. PATENT DOCUMENTS

| | | | | |
|---|---|---|---|---|
| 9,702,029 | B2 | 7/2017 | Fripp et al. | |
| 9,920,601 | B2 * | 3/2018 | Carrejo | E21B 43/12 |
| 10,294,750 | B2 * | 5/2019 | Aitken | E21B 43/12 |
| 2007/0039741 | A1 * | 2/2007 | Hailey, Jr. | E21B 34/10 166/376 |
| 2009/0084553 | A1 | 4/2009 | Rytlewski et al. | |
| 2011/0139465 | A1 * | 6/2011 | Tibbles | E21B 33/124 166/387 |
| 2013/0186626 | A1 * | 7/2013 | Aitken | E21B 34/06 166/285 |
| 2013/0228341 | A1 * | 9/2013 | Fripp | E21B 43/12 166/373 |
| 2014/0020898 | A1 * | 1/2014 | Holderman | E21B 43/08 166/304 |
| 2014/0262207 | A1 * | 9/2014 | Lopez | E21B 34/08 166/114 |
| 2014/0305630 | A1 * | 10/2014 | Kang | E21B 34/063 166/205 |
| 2014/0367116 | A1 | 12/2014 | Lopez | |
| 2015/0308238 | A1 * | 10/2015 | Langlais | E21B 34/06 166/278 |
| 2015/0308239 | A1 | 10/2015 | Langlais et al. | |
| 2015/0330191 | A1 * | 11/2015 | Holderman | E21B 43/12 166/205 |
| 2016/0040516 | A1 * | 2/2016 | Richards | B29C 65/02 166/244.1 |
| 2016/0230498 | A1 | 8/2016 | Walton et al. | |
| 2016/0290090 | A1 | 10/2016 | Murphree et al. | |
| 2018/0223624 | A1 * | 8/2018 | Fripp | E21B 34/063 |
| 2018/0328139 | A1 * | 11/2018 | Mhaskar | E21B 34/063 |
| 2019/0169959 | A1 * | 6/2019 | Kumar | E21B 43/12 |

OTHER PUBLICATIONS

Patent Cooperation Treaty, International Searching Authority, International Search Report and Written Opinion, PCT Appln. No. PCT/US2016/042048 dated Apr. 11, 2017.

* cited by examiner

TWO-PART DISSOLVABLE FLOW-PLUG FOR A COMPLETION

TECHNICAL FIELD

The present disclosure relates to downhole tools for use in a wellbore environment and more particularly to two-part dissolvable flow-plugs for use in regulating fluid flow in a completion.

BACKGROUND

After a wellbore has been formed, various downhole tools may be inserted into the wellbore to extract the natural resources such as hydrocarbons or water from the wellbore, to inject fluids into the wellbore, and/or to maintain the wellbore. At various times during production, injection, and/or maintenance operations, it may be necessary to regulate fluid flow into or out of various portions of the wellbore or various portions of the downhole tools used in the wellbore. For example, a flow-plug may be used to block a flow path to prevent the ingress of fluids into the completion.

The flow-plug may generally be described as temporary, as it may not be desired to permanently plug the flow path throughout the useful life of the completion. Some temporary flow-plugs may function until removal is desired, at which point an affirmative step may be taken to remove the flow-plug. Alternatively, some temporary flow-plugs may be designed such that they fail when desired without the need for an affirmative step after their useful life has passed.

One method of removing temporary flow-plugs is to dissolve the flow-plug with a specific solvent. However, this method may not provide the amount of control that an operator desires. For example, if the flow-plug is only able to be removed through contact with a sufficient amount of the specific solvent, the operator will have little choice but to use the solvent to remove the flow-plug. If the operator later learns that the solvent may cause issues, either with other downhole equipment or the subterranean formation, the operator would have to find an alternative to the solvent, and if none exists, may have to remove and redo the completion with a flow-plug that does not require dissolution in said specific solvent.

Additionally, in completions utilizing multiple dissolvable flow-plugs, the solvent will take the path of least resistance. Therefore, the first flow-plug to be dissolved will consequently be the location at which most of the subsequently pumped solvent flows through. As such, dissolution of any remaining flow-plugs may not occur or may occur at a rate which reduces the productivity of the well.

Alternatively, some temporary flow-plugs may use mechanical means of removal. However, as with the dissolving flow-plugs, if the removal mechanism fails or would be damaging to the well, the operator is left with little recourse to correct the issue, except to remove and redo the completion or to operate around the failed flow-plug.

BRIEF DESCRIPTION OF THE DRAWINGS

Illustrative examples of the present disclosure are described in detail below with reference to the attached drawing figures, which are incorporated by reference herein, and wherein.

The illustrated figures are only exemplary and are not intended to assert or imply any limitation with regard to the environment, architecture, design, or process in which different examples may be implemented.

DETAILED DESCRIPTION

The present disclosure relates to downhole tools for use in a wellbore environment and more particularly to two-part dissolvable flow-plugs for use in regulating fluid flow in a completion.

Disclosed herein are examples of and methods for plugging a flow path with a two-part dissolvable flow-plug. The two-part dissolvable flow-plug may be a permanent or temporary flow-plug as desired. The flow-plug comprises two component parts. The two component parts may be dissolved with a suitable solvent. The two component parts are made of two different dissolvable materials and may be dissolved through the use of different solvents and/or may be dissolved through the use of the same solvent albeit at different rates of dissolution. Alternatively, the flow-plug may be removed through the dissolution of just the retaining component whereby the plugging component may then be pushed out of a flow path through the flow of wellbore fluids in one direction of the flow path. As such, if the dissolution of both components is not desirable, a mechanical means for removing the plug may be used alternatively.

A production assembly may be part of a completion and may comprise a production string, downhole tools, and one or more flow paths. The flow path may allow for the ingress and/or egress of wellbore fluids and/or treatment fluids in the production assembly. The production assembly may also comprise a fluid flow regulating device, for example, an inflow control device, which may be used to regulate the flow of fluids between the wellbore and the production assembly. In some examples, the flow regulating device may comprise the flow path. In alternative examples, the production assembly may comprise a flow path without a fluid flow regulating device. For some downhole operations, it may be desirable to plug a flow path to prevent the burst or collapse of the flow path. Further, once positioned it may be desirable to plug the flow path until fluid production through the production string is desired. Embodiments of the present disclosure and its advantages may be understood by referring to FIGS. 1 through 4B, where like numbers are used to indicate like and corresponding parts.

Figure 1:
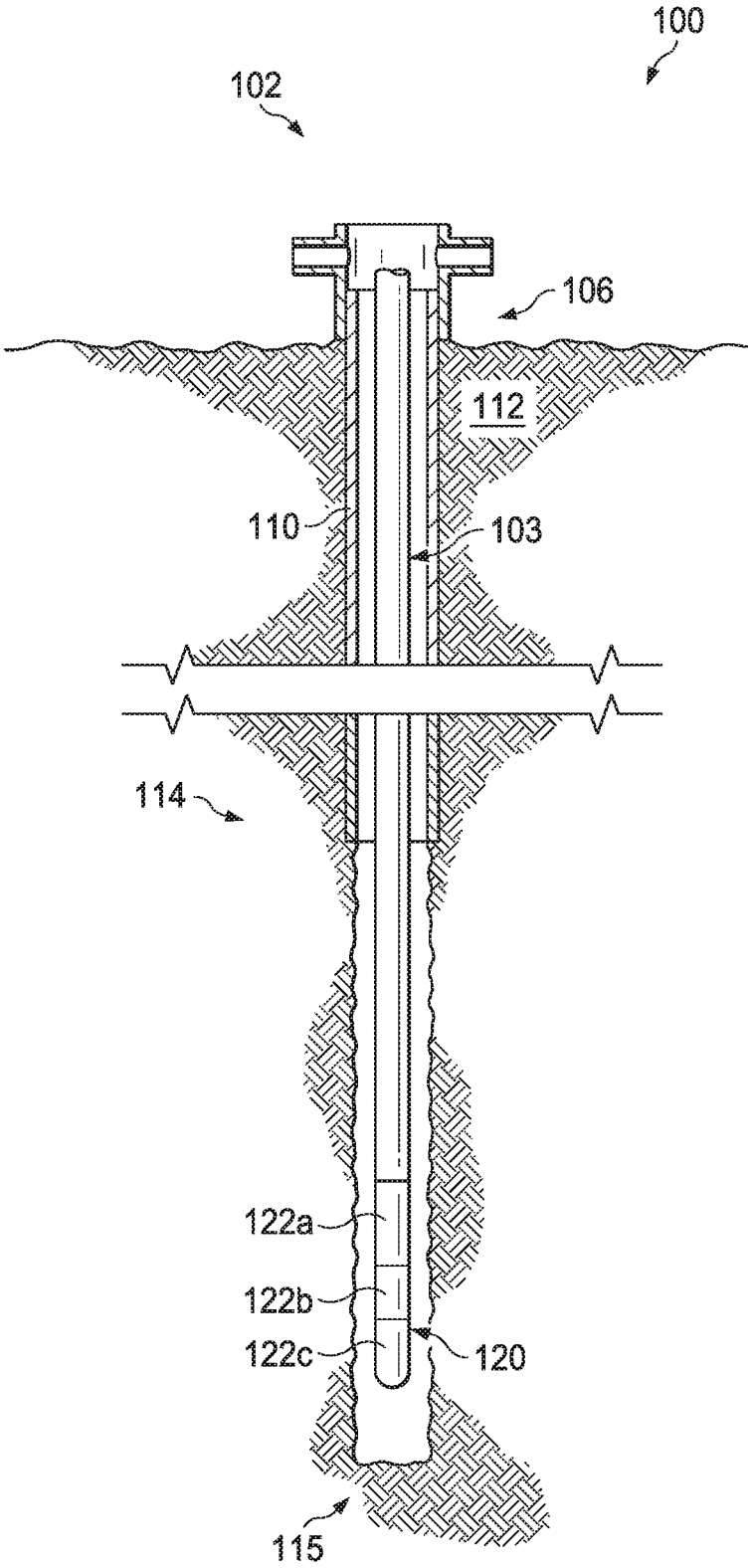
FIG. 1 is an elevation view of a well-production system.

FIG. 1 is an elevation view of a well-production system 100. Well-production system 100 may be located at well site 102. Various types of equipment such as a rotary table, drilling fluid or production fluid pumps, tubulars, casing equipment, drilling fluid tanks (not expressly shown), and other drilling or production equipment may be located at well site 102. Well-production system 100 may include wellhead 106. The wellhead 106 may include various characteristics and features associated with a well-production system 100 including a Christmas tree, isolation equipment, choke equipment, tubing hangers, etc. Although an onshore well-production system 100 is disclosed, it is to be understood that the teachings of the present disclosure may be used at any offshore well sites and with any related offshore equipment including surface and subsea wellheads.

Well-production system 100 may also include production string 103, which may be used to produce hydrocarbons such as oil and gas and other natural resources such as water from formation 112 via wellbore 114. Production string 103 may also be used to inject hydrocarbons such as oil and gas and other natural resources such as water into formation 112 via wellbore 114. Although wellbore 114 is drawn with a substantially vertical section showing (e.g., substantially perpendicular to the surface), it should be understood that wellbore 114 may follow any given trajectory obtainable, including one or more vertical and one or more non-vertical sections, by virtue of having been drilled using modern directional drilling techniques.

Casing string 110 is optionally provided in the instance of cased-hole completions. The casing string 110 may extend to a desired depth of wellbore 114 and held in place by cement, which may be injected in an annulus between casing string 110 and the sidewalls of wellbore 114. Casing string 110 may provide radial support to wellbore 114 and may seal against unwanted communication of fluids between wellbore 114 and surrounding formation 112. Casing string 110 may extend from wellhead 106 to a selected downhole location within wellbore 114. Portions of wellbore 114 that do not include casing string 110 may be referred to as open hole. In some cases no casing string 110 is required, which may be referred to as open-hole completions.

The terms uphole and downhole may be used to refer to the location of various components relative to the lower end 115 (i.e. bottom) of wellbore 114 shown in FIG. 1. For example, a first component described as uphole from a second component may be further away from the lower end 115 of wellbore 114 than the second component. Similarly, a first component described as being downhole from a second component may be located closer to the lower end 115 of wellbore 114 than the second component.

Well-production system 100 may also include production assembly 120 coupled to production string 103. Production assembly 120 may be used to perform operations relating to the completion of wellbore 114, production of hydrocarbons and other natural resources from formation 112 via wellbore 114, injection of hydrocarbons and other natural resources into formation 112 via wellbore 114, and/or maintenance of wellbore 114. Production assembly 120 may be located at the lower end 115 of wellbore 114 or at a point uphole from the lower end 115 of wellbore 114. Production assembly 120 may be formed from a wide variety of components configured to perform these operations. For example, components 122*a*, 122*b*, and 122*c* of production assembly 120 may include all manner of flow paths, fluid flow regulating devices (e.g., passive inflow control devices, electronic inflow control devices, packers, valves, nozzles), and the like. The number and types of components 122 included in production assembly 120 may depend on the type of wellbore, the operations being performed in the wellbore, and anticipated wellbore conditions.

Fluids may be extracted from or injected into wellbore 114 via production assembly 120 and production string 103. For example, production fluids, including hydrocarbons, water, sediment, and other materials or substances found in formation 112 may flow from formation 112 into wellbore 114 through the sidewalls of open hole portions of wellbore 114. The production fluids may circulate in wellbore 114 before being extracted from wellbore 114 via production assembly 120 and production string 103. Additionally, injection fluids, including hydrocarbons, water, and other materials or substances, may be injected into wellbore 114 and formation 112 via production string 103 and production assembly 120. Production assembly 120 may include a screen (e.g., screen 202, as illustrated in FIG. 2) to filter sediment from fluids flowing between wellbore 114 and production assembly 120.

As discussed above, production assembly 120 may include a flow-plug to restrict the flow of fluids between wellbore 114 and production assembly 120. Fluid flow through the flow path may be completely or partially blocked, such that, most or all of the fluid flow through the flow path comprising the flow-plug is restricted. The flow-plug may hold burst and collapse pressure during run-in of the production assembly 120. When fluid flow through the flow path is desired, the flow-plug may be removed.

Figure 2:
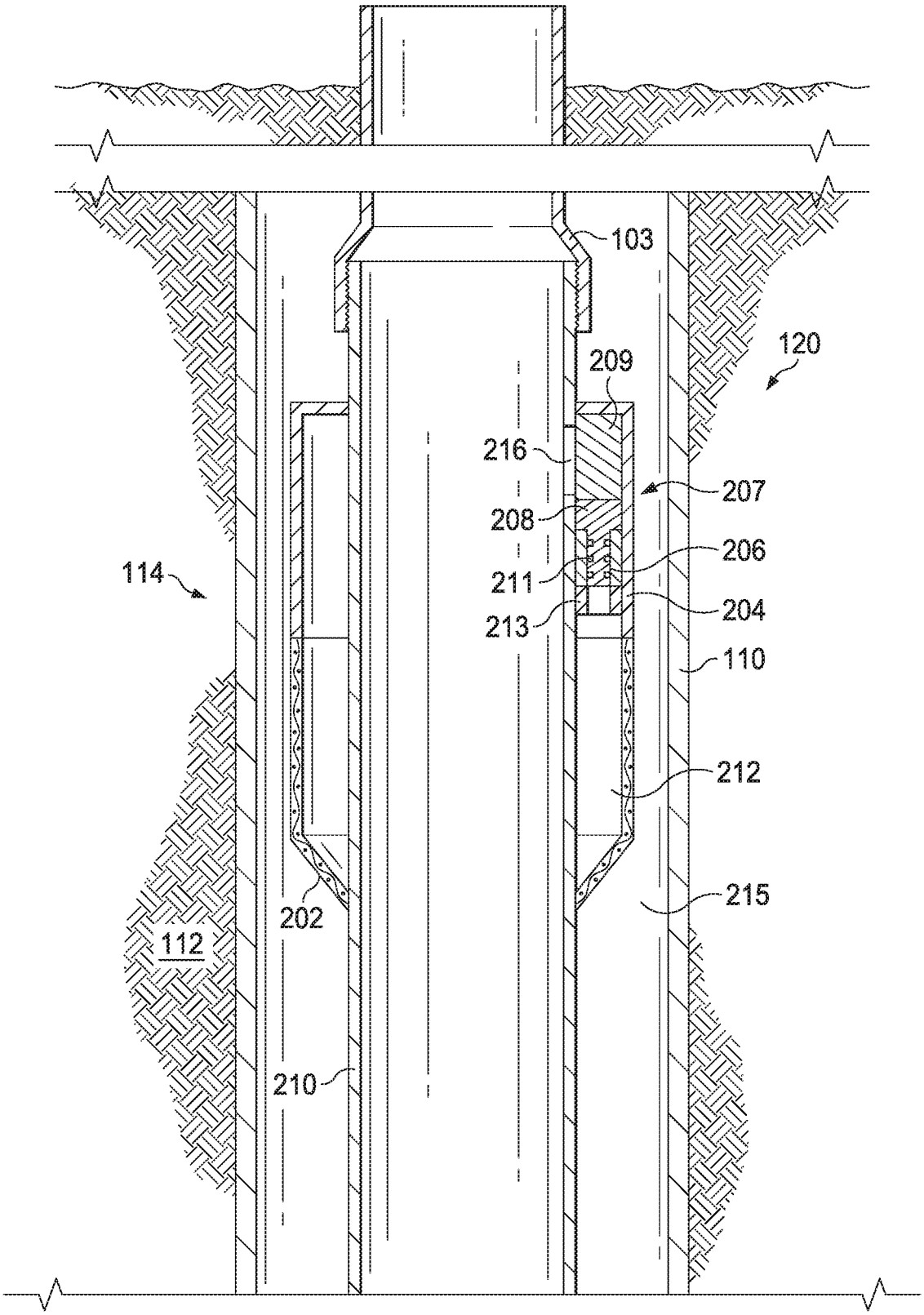
FIG. 2 is a cross-sectional view of a production assembly including an inflow control device plugged with a two-part dissolvable flow-plug.

FIG. 2 is a cross-sectional view of a production assembly 120 comprising flow path 206. Production fluids circulating in the wellbore 114 may flow through production assembly 120 into production string 103. Similarly, injection fluids circulating in production string 103 may flow through production assembly 120 into the wellbore 114. Production assembly 120 may be located downhole from production string 103 and may be coupled to production string 103 via tubing 210. Production assembly 120 may be coupled to production string 103 by a threaded joint. Alternatively, a different coupling mechanism may be employed.

Production assembly 120 may include screen 202 and shroud 204. Both screen 202 and shroud 204 may be coupled to and positioned around the circumference of tubing 210 such that annulus 212 is formed between the inner surfaces of screen 202 and shroud 204 and the outer surface of tubing 210. Screen 202 may be configured to filter sediment from fluids as they flow through screen 202. Screen 202 may include, but is not limited to, a sand screen, a gravel filter, a mesh, or slotted tubing.

Production assembly 120 may also include flow path 206 positioned within or adjacent to annulus 212. The flow path 206 may be positioned between shroud 204 and tubing 210. In some examples, flow path 206 may engage with shroud 204 and tubing 210 to regulate fluids circulating in annulus 212 and flowing between flow path 206 and tubing 210 or shroud 204. Fluids circulating in the wellbore 114 may enter production assembly 120 by flowing through screen 202 into annulus 212. From annulus 212, fluids may flow through flow path 206 and into tubing 210 through opening 216 formed in the sidewall of tubing 210. Similarly, fluids circulating in production string 103 may enter the wellbore 114 by flowing through opening 216 formed in the sidewall of tubing 210 and into annulus 212. From annulus 212, fluids may flow through flow path 206, through screen 202, and into the wellbore 114.

Two-part dissolvable flow-plug 207 is positioned in or adjacent to flow path 206 such that fluid flow through flow path 206 at least partially restricted, and the pressure differential on either side of the two-part dissolvable flow-plug is substantially maintained. Flow path 206 may be any fluid and/or pressure pathway in any part or component of the completion including, but not limited to, the production assembly 120, production string 103, etc. Flow path 206 may be a flow path through any type of conduit, tubular, or structure. Flow path 206 may allow for fluid and/or pressure communication between any areas proximate the ends of flow path 206. It is to be understood that in some examples, two-part dissolvable flow-plug 207 may form a fluid and/or pressure tight seal such that there is no fluid or pressure communication on either side of said fluid and/or pressure tight seal. In other examples, fluid and/or pressure leakage across two-part dissolvable flow-plug 207 may occur at one or multiple periods over the useful life of two-part dissolvable flow-plug 207. Operation of two-part dissolvable flow-plug 207 is intended to minimize said leakage such that any impact on a downhole operation or any downhole equipment is negligible. As such, two-part dissolvable flow-plug 207 may be used to hold the burst and/or collapse pressure when the production assembly 120, or any part of the completion comprising the two-part dissolvable flow-plug 207, is run-in the wellbore 114.

Two-part dissolvable flow-plug 207 may comprise two component parts, the plugging component 208 and the retaining component 209. The plugging component 208 is designed and positioned such that it forms a seal in flow path 206 which restricts fluid and pressure communication on either side of the seal. As illustrated in FIG. 2, plugging component 208 comprises O-rings 211 to form the seal. The seal may be formed proximate an optional flow regulating device 213. The flow regulating device 213 may be any flow regulating device for use in production assembly 120, including, but not limited to, an inflow control device, a packer, a valve, a nozzle, a helix, and the like. In some examples, the production assembly 120 may not comprise a flow regulating device 213. In some alternative examples, flow path 206 may be positioned inside flow regulating device 213 proximate an opening of the flow regulating device 213. The retaining component 209 is positioned adjacent to the plugging component 208 and functions to retain the plugging component 208 in place. If the retaining component 209 is removed, the plugging component 208 may be pushed out of position by wellbore fluids during production flow. Alternatively, if the retaining component 209 is removed, the plugging component 208 may be pushed out of position by treatment fluids or other fluids within the production string 103 during injection flow. In some examples, the plugging component 208 is shaped such that it may be pushed out of position by both production flow and injection flow. In some examples, the plugging component 208 is shaped such that it may only be pushed out of position by injection flow. In some alternative examples, the plugging component 208 is shaped such that it may only be pushed out of position by production flow. If the plugging component 208 is pushed out of position by injection flow, the plugging component 208 may be pushed out of position within flow path 206 into an area outside of the production string, for example, annulus 212 between shroud 204 and tubing 210, or into the annulus 215 between the production string 103 and the cased or uncased wall of the wellbore 114 by injection flow. If the plugging component 208 is pushed out of position by production flow, the plugging component 208 may be pushed out of position within flow path 206 into an area inside of the production string, for example, any tubing 210 comprising the production string 103. If the plugging component 208 is pushed out position within flow path 206, the seal formed by the plugging component 208 may be removed.

Although production assembly 120 is illustrated as comprising a single flow path 206, multiple flow paths 206 may be utilized to restrict fluid flow into production assembly 120 from a wellbore 114. For example, flow paths 206 may be located at multiple locations within the wellbore 114 in order to restrict fluid flow into or out of the production assembly 120 or any other completions equipment within wellbore 114. Any number and any combination of species of flow paths 206 may be used as desired.

Figure 3A:
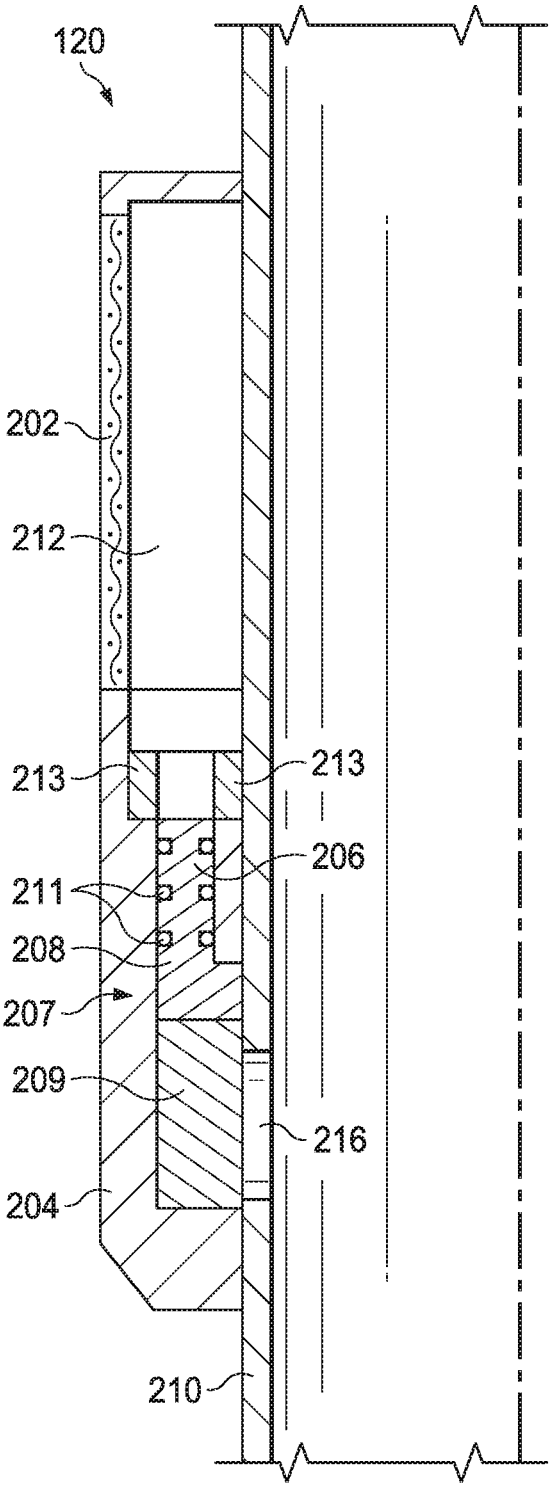
FIG. 3A is a cross-sectional view of a flow path comprising a two-part dissolvable flow-plug.
Figure 3B:
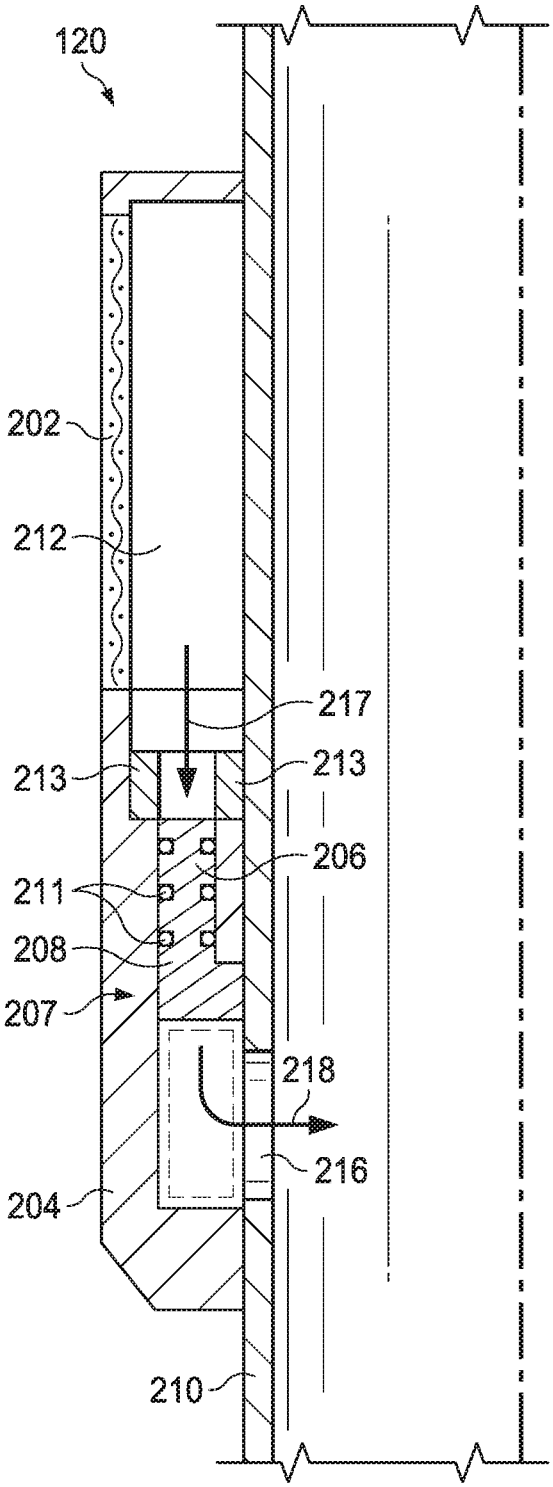
FIG. 3B is a cross-sectional view of a flow path comprising a two-part dissolvable flow-plug in which the retaining component has dissolved.

Now referring to FIGS. 3A and 3B, FIG. 3A is a cross-sectional view of a flow path 206 comprising a two-part dissolvable flow-plug 207. FIG. 3B is a cross-sectional view of a flow path 206 comprising a two-part dissolvable flow-plug 207 in which the retaining component 209 has dissolved. As illustrated in FIGS. 3A and 3B, the two-part dissolvable flow-plug 207 has formed a seal within the example flow path 206. The plugging component 208 and retaining component 209 comprise two different dissolvable materials. The two different dissolvable materials dissolve at different rates relative to each other in the same solvent. For example, the dissolvable material of the retaining component 209 may dissolve at a faster rate in a brine which may be circulated in tubing 210 during early production or wellbore cleanup. As can be observed from FIG. 3A, the retaining component 209 is positioned to retain the plugging component 208 in a fixed position and to hold the collapse pressure thereby preventing the plugging component 208 from potentially being pushed into the interior of the flow path and the tubing 210. In this example, the plugging component 208 is shaped such to hold burst pressure, and thus a fluid may be circulated in the inner diameter of tubing 210 even after the retaining component 209 has been dissolved in this example. In alternative examples, the plugging component 208 may be shaped to be pushed out of position by injection flow after the retaining component 209 has been removed.

The plugging component 208 and retaining component 209 may be made of dissolvable materials. The dissolvable materials may dissolve in a desired solvent. Examples of the dissolvable materials include dissolvable metals. Examples of dissolvable metals include, but are not limited to, magnesium, aluminum, zinc, iron, tin, copper, manganese, alloys (e.g., magnesium alloys, aluminum alloys, iron alloys, steel, bronze, etc.) thereof, or a combination thereof. The dissolvable metals may degrade through dissolution, galvanic action, microgalvanic action, corrosion, disassociation, and the like. In some examples comprising alloys, the alloys may be selected specifically to adjust the rate of dissolution to a desired rate. For example, the plugging component 208 may comprise a cast iron alloy as compared to an aluminum alloy if a slower rate of dissolution in an acid is desired. Alternatively, the plugging component 208 may comprise a magnesium alloy as compared to an aluminum alloy if a faster rate of dissolution in an acid is desired. Further alternatively, the dissolvable materials may be doped with other materials to accelerate degradation by creating sites for cathodic corrosion. For example, the dissolvable materials may comprise cathodic materials used as dopant including, but not limited to, zinc, iron, nickel, tin, copper, silver, zirconium, titanium, gold, carbon, allotropes thereof (e.g., graphite), or a combination thereof. For example, a magnesium alloy may be doped to increase the rate of degradation compared to the same undoped magnesium alloy. The dopant may be added to the dissolvable metals by a powder metallurgy process or a solid solution process. In a powder metallurgy process the cathodic dopant areas are pressed or forged with the anodic metal (i.e. the dissolvable metal). In a solid solution process, the cathodic dopant comprises a cathodic phase within the dissolvable metal and forms as intergranular or intragranular regions around the grains of the dissolvable metal. The dopant may be a nanocomposite or may form intergranular and intragranular cathodic phases. In some examples, the dissolvable materials may be coated with a protective layer to delay dissolution of the materials. With the benefit of this disclosure, one of ordinary skill in the art will be readily able to select dissolvable metals for the provided methods.

The dissolvable materials may also comprise dissolvable polymers. The dissolvable polymers may degrade hydrolytically or may degrade in a hydrocarbon. Examples of dissolvable polymers include, but are not limited to, polyglycolic acid, polylactic acid, thiol polymers, polyacrylate, polyurethane, polystyrene, poly(caprolactone), polyhydroxyalkonate, a polyaryletherketone (e.g., polyether ether ketone), neoprene, isoprene, butyl rubber, nitrile rubber, EPDM rubber, or combinations thereof. The dissolvable polymers may be aliphatic or aromatic as desired. With the benefit of this disclosure one of ordinary skill in the art will be readily able to select dissolvable polymers for the provided methods.

In some examples the dissolvable materials may comprise a coating to delay degradation as desired. For example, the dissolvable materials may be anodized, coated with a coating (e.g., polytetrafluoroethylene), or painted. Alternatively, the dissolvable metals may be alloyed with elements that prevent the formation of protecting passivating layers. For example, post-transition metals such as gallium, indium, and tin may act as depassivating agents and resist passivation on the dissolvable alloys. Examples of these alloys include 80% Al-20% Ga, 80% Al-10% Ga-10% In, 75% Al-5% Ga-5% Zn-5% Bi-5% Sn-5% Mg, 90% Al-2.5% Ga-2.5% Zn-2.5% Bi-2.5% Sn, 99.8% Al-0.1% In-0.1% Ga, and the like. With the benefit of this disclosure, one of ordinary skill in the art will be readily able to select dissolvable materials for the provided methods and to determine whether the dissolvable materials require protective coatings or depassivating agents.

It is to be understood that the plugging component 208 and the retaining component 209 are to comprise two different dissolvable materials such that their rate of dissolution in the same solvent is different. This does not necessarily exclude examples where the plugging component 208 and retaining component 209 comprise the same dissolvable materials, for example, both the plugging component 208 and retaining component 209 may comprise an alloy of magnesium and aluminum; however, the percentage of the aluminum in the alloy of the plugging component 208 may be greater than the percentage of the aluminum in the alloy of the retaining component 209, such that the plugging component 208 dissolves at a slower rate in a brine than the retaining component 209. As such, the plugging component 208 and retaining component 209 may comprise alloys comprising some or all of the same dissolvable materials; however, the alloys may not be the same. Additionally, the plugging component 208 and the retaining component 209 may comprise the same materials but have a different processing such that the plugging component 208 and the retaining component 209 have different rates of degradation. For example, the plugging component 208 may be a solid plastic and the retaining component 209 may be a foamed plastic.

Plugging component 208 and retaining component 209 may be any shape and structure such that they are capable of being configured to fulfill their desired functions described herein. As the two-part dissolvable flow-plug 207 may be used in any desirable flow path 206, the shape and structure of the plugging component 208 and retaining component 209 may be configured to function within the structural limitations of the chosen flow path 206. For example, in FIG. 3A the retaining component 209 is generally a block shape that is able to fit within the interior of the flow path 206 and is positioned adjacent to the plugging component 208 such that it is able to retain the plugging component 208 without the need for attachment to the plugging component 208 or attachment to the flow path 206. As such, the retaining component 209 is able to hold collapse pressure within the flow path 206. Alternatively, in the illustrated examples the retaining component 209 may comprise a retaining ring, a spring, and the like. Plugging component 208 may generally be shaped such that it is able to hold a fixed position via contact with retaining component 209 and is able to hold burst pressure during run-in. Plugging component 208 may also be shaped such that it is able to be pushed out of position by production flow and/or injection flow if the retaining component 209 has been removed. In the example illustrated by FIG. 3A, the cross-section of plugging component 208 is generally illustrated as having an L-shape. In the example illustrated by FIG. 2, the cross-section of plugging component 208 is generally illustrated as having a T-shape. In some examples, the plugging component 208 may be cylindrical. In some examples, the plugging component 208 may be a frustum. In some examples, the plugging component 208 may be a sphere, spheroid, or other curvilinear shape. With the benefit of this disclosure one of ordinary skill in the art will be able to provide a shape and structure for the plugging component 208 and the retaining component 209 sufficient to produce a two-part dissolvable flow-plug 207 capable of holding both burst and collapse pressure during run-in and capable of being removed by the methods and in the manners described herein.

The solvent for dissolving the dissolvable materials may be any suitable solvent sufficient for dissolving the dissolvable materials. For example, the solvent may be any suitable fluid for degrading the structural integrity and/or accelerating the breakdown of the dissolvable materials. In some examples the solvent may only dissolve the dissolvable materials comprising one of the plugging component 208 or the retaining component 209. For example, the solvent may only dissolve the retaining component 209. In such examples, a second solvent may be used to dissolve the plugging component 208 if dissolution of the plugging component 208 is desirable. The solvent may be a wellbore fluid used in producing operations. The solvent may include, but should be limited to, water, steam, $CO_2$, mud, produced fluids, brines, organic acids, inorganic acids, oxidizing fluids, hydrocarbon fluids, or a combination thereof. In some examples the solvent and dissolvable materials are selected such that the dissolution rate of the dissolvable materials in the solvent is a desired rate of dissolution and also that the use of the solvent in the wellbore does not negatively affect the subterranean formation or downhole equipment which may contact the solvent.

With continued reference to FIGS. 3A and 3B, the dissolvable materials comprising the plugging component 208 were selected such that they dissolve at a slower rate in a brine relative to the dissolvable materials comprising the retaining component 209. After said brine has been pumped through tubing 210, at least a portion of retaining component 209 may be dissolved as illustrated in FIG. 3B. In this example, the seal formed by plugging component 208 is still in place in FIG. 3B and plugging component 208 is shaped such that plugging component 208 is still capable of holding burst pressure and thus allowing fluid circulation through tubing 210. Once a portion of the retaining component 209 is dissolved, production fluids entering annulus 212 via screen 202 (or other such opening) may then be used to push plugging component 208 in the direction indicated by reference arrow 217 into the tubing 210 via opening 216 and as indicated by reference arrow 218. In the illustrated example, the plugging component 208 is thus able to be removed by production flow without the need to dissolve plugging component 208. Although FIG. 3B illustrates that the entirety of retaining component 209 has been dissolved, it is to be understood that only a portion of retaining component 209 may need to be dissolved for plugging component 209 to be removed. For example, a solvent capable of dissolving plugging component 209 may be capable of contacting and dissolving a portion or all of plugging component 209 with only a portion of retaining component 209 dissolved and/or removed. Further, only a portion of retaining component 209 may need to be dissolved and/or removed for production and/or injection flow to push plugging component 208 out of position within flow path 206.

Figure 4A:
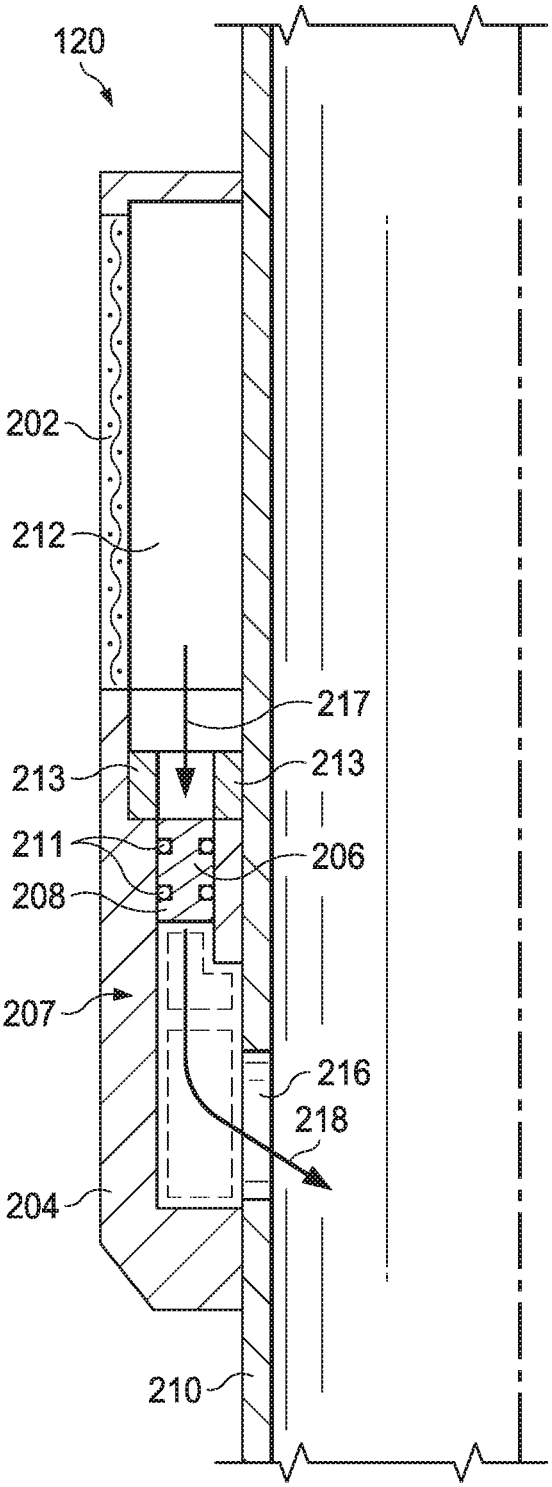
FIG. 4A is a cross-sectional view of the flow path illustrated in FIG. 3B in which a portion of the plugging component of the two-part dissolvable flow-plug has been dissolved.
Figure 4B:
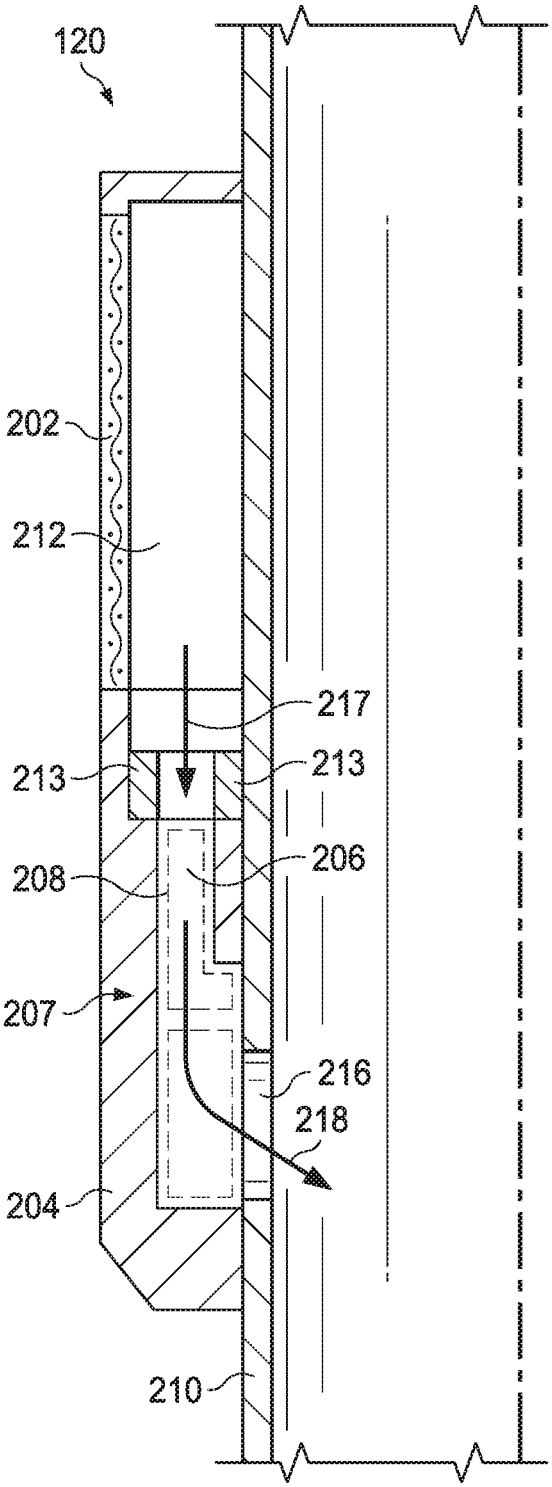
FIG. 4B is a cross-sectional view of the flow path illustrated in FIG. 3B in which the entirety of the plugging component of the two-part dissolvable flow-plug has been dissolved.

Now referring to FIGS. 4A and 4B, FIG. 4A is a cross-sectional view of the flow path 206 illustrated in FIG. 3B in which a portion of the plugging component 208 of the two-part dissolvable flow-plug 207 has been dissolved. FIG. 4B is a cross-sectional view of flow path 206 illustrated in FIG. 3B in which the entirety of the plugging component 208 of the two-part dissolvable flow-plug 207 has been dissolved. As illustrated in FIG. 4A, once a portion of the retaining component 209 is dissolved an optional second solvent may be pumped into tubing 210 to dissolve at least a portion of plugging component 208. After dissolution of at least a portion of the plugging component 208, production fluids entering annulus 212 via screen 202 (or other such opening) may then be used to push any remaining portion of plugging component 208 in the direction indicated by reference arrow 217 into the tubing 210 via opening 216 and as indicated by reference arrow 218. As illustrated in FIG. 4B, once a portion of the retaining component 209 is dissolved a second solvent may be pumped into tubing 210 to dissolve plugging component 208. In the example illustrated in FIG. 4B, the second solvent has dissolved the entirety of the plugging component 208. After dissolution of the plugging component 208, production fluids entering annulus 212 via screen 202 (or other such opening) enter the inflow control device 206 in the direction indicated by reference arrow 217 and may flow into the tubing 210 via opening 216 and as indicated by reference arrow 218. In some examples the o-rings 211 may also be made of the dissolvable materials. For example, the o-rings 211 may be made of a dissolvable material such as polyacrylate, polyurethane, neoprene, isoprene, butyl rubber, nitrile rubber, EPDM rubber, or combinations thereof. In some examples, the o-rings 211 may be dissolved in the same solvent which may be used to dissolve the plugging component 208. In alternative examples, the o-rings may be dissolvable in a solvent different than a solvent which may be used to dissolve the plugging component 208. In further alternative examples, the o-rings 211 may not be dissolvable.

Figure 5:
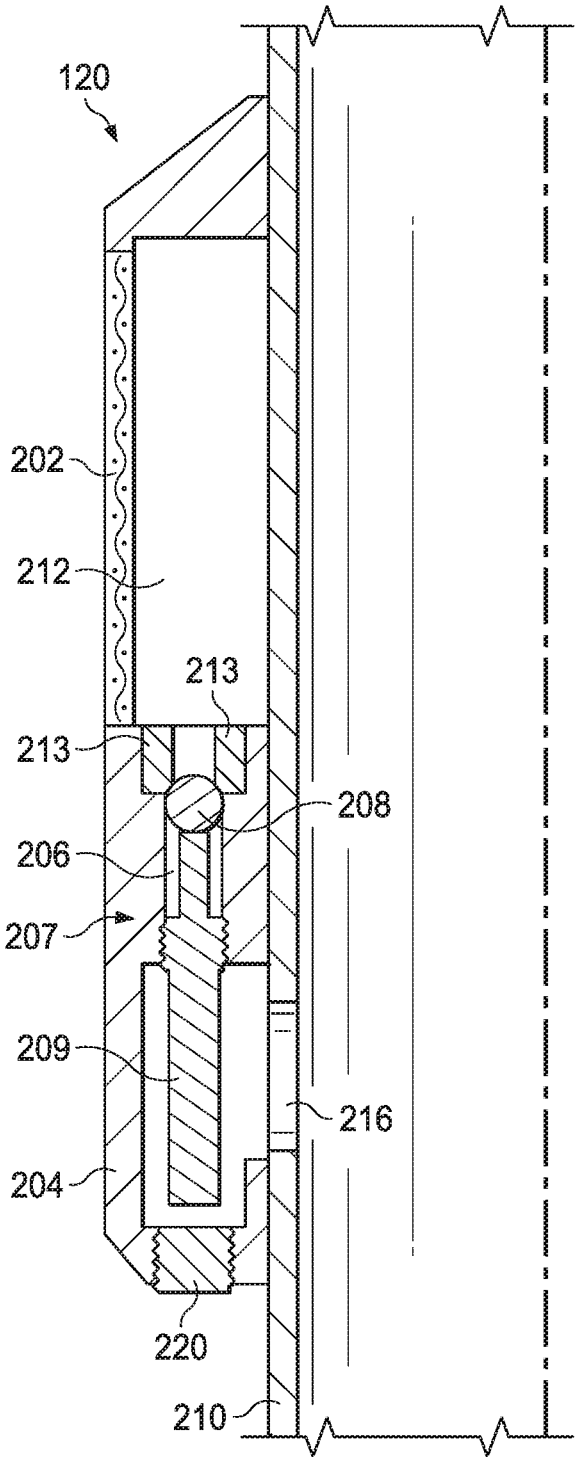
FIG. 5 is a cross-sectional view of a flow path comprising a two-part dissolvable flow-plug with a substitutable retaining component.

FIG. 5 is a cross-sectional view of a flow path 206 comprising a two-part dissolvable flow-plug 207 with a substitutable retaining component 209. As illustrated in FIG. 5, the two-part dissolvable flow-plug 207 has formed a seal within the example flow path 206. The plugging component 208 and retaining component 209 comprise two different dissolvable materials. In this specific example, the retaining component 209 comprises polyglycolic acid and is shaped such that it has been threaded into the inner diameter of the flow path 206. The plugging component 208 comprises polyether ether ketone, which may only dissolve at a very slow rate in only a limited variety of solvents and may also resist biodegradation. The plugging component 208 is shaped as a sphere, spheroid, or other similar curvilinear shape. In this specific example, the plugging component 208 may form a seal in flow path 206 against a flow regulating device 213 (e.g., an inflow control device) positioned within flow path 206 or adjacent flow path 206. Further, the shroud 204 of the production assembly 120 comprises a removable component 220. Removable component 220 may be removed from the shroud 204 at any time, for example, removable component 220 may be removed when production assembly 120 is disposed in a wellbore (e.g., wellbore 114 as illustrated in FIG. 1) or when production assembly 120 is not disposed in a wellbore. Upon removal of removable component 220, retaining component 209 may be substituted for another retaining component 209. In some examples, retaining component 209 may be substituted for a retaining component 209 comprised of a material which may not dissolve or degrade, or which may greatly resist dissolution or degradation such that the seal formed by plugging component 208 in flow path 206 may maintained permanently or for a much longer duration relative to the previously installed retaining component 209.

As discussed above, a production assembly 120 may comprise a plurality of flow paths 206 comprising two-part dissolvable flow-plugs 207. As the plugging component 208 may maintain a seal even after dissolution of the retaining component 209 and exposure to the solvent used to dissolve the retaining component 209, thus a solvent used to dissolve a retaining component 209 may also dissolve multiple retaining components while in the interior of a tubing 210 without exiting through any flow paths 206. As such, a fluid circulated in the tubing 210, for example the aforementioned solvent of the retaining component 209, may be circulated in the tubing 210 such that it is able to dissolve a plurality of retaining components 209 while mitigating the risk of the fluid taking the path of least resistance and exiting through the first flow path 206 for which the retaining component 209 was at least partially dissolved. A subsequent solvent, production fluid, or a combination of a subsequent solvent and production fluids may then be used to dissolve and/or push the plugging component 208 out of the flow path 206. Therefore, the disclosed examples illustrate that the methods described herein mitigate the risk that only one or only some of the two-part dissolvable flow-plugs 207 within a plurality of two-part dissolvable flow-plugs 207 may be successfully removed.

Well systems for plugging and unplugging a flow path in a subterranean formation are provided. An example well system comprises a flow path comprising a two-part dissolvable flow-plug, the two-part dissolvable flow-plug comprising: a retaining component, and a plugging component adjacent to the retaining component; wherein the retaining component comprises a dissolvable material; and wherein the flow path is in fluid communication with a tubing. The retaining component may be configured to retain the plugging component in a fixed position. The plugging component may comprise a dissolvable material different from the dissolvable material of the retaining component. The plugging component may be configured to hold the burst pressure of the flow path without the retaining component present. The dissolvable material may comprise a dissolvable metal selected from the group consisting of magnesium, aluminum, zinc, iron, tin, copper, manganese, alloys thereof, and combinations thereof. The dissolvable material may comprise a dissolvable polymer selected from the group consisting of polyglycolic acid, polylactic acid, thiol polymers, polyacrylate, polyurethane, polystyrene, poly(caprolactone), polyhydroxyalkonate, polyether ether ketone, neoprene, isoprene, butyl rubber, nitrile rubber, EPDM rubber, and combinations thereof. The dissolvable material may be a hydrolytically degradable polymer. The dissolvable material may be doped. The dissolvable material may comprise a depassivating agent selected from the group consisting of gallium, indium, tin, and combinations thereof. The well system may further comprise a plurality of flow paths, wherein each individual flow path within the plurality comprises a two-part dissolvable flow-plug.

Methods for plugging and unplugging a flow path are provided. An example method comprises providing a flow path comprising a two-part dissolvable flow-plug, wherein the flow path is coupled to a tubing disposed in a wellbore, and wherein the two-part dissolvable flow-plug comprises a plugging component and a retaining component; circulating a solvent in the tubing to dissolve at least a portion of the retaining component; and allowing a produced fluid circulating in the annulus between the tubing and the wellbore to push the plugging component into the interior of the tubing. The retaining component and the plugging component may comprise two dissolvable materials. The retaining component may be configured to retain the plugging component in a fixed position. The plugging component may comprise a dissolvable material different from the dissolvable material of the retaining component. The plugging component may be configured to hold the burst pressure of the flow path without the retaining component present. The dissolvable materials may comprise a dissolvable metal selected from the group consisting of magnesium, aluminum, zinc, iron, tin, copper, manganese, alloys thereof, and combinations thereof. The dissolvable materials may comprise a dissolvable polymer selected from the group consisting of polyglycolic acid, polylactic acid, thiol polymers, polyacrylate, polyurethane, polystyrene, poly(caprolactone), polyhydroxyalkonate, polyether ether ketone, neoprene, isoprene, butyl rubber, nitrile rubber, EPDM rubber, and combinations thereof. The dissolvable materials may be a hydrolytically degradable polymer. The dissolvable materials may be doped. The dissolvable materials may comprise a depassivating agent selected from the group consisting of gallium, indium, tin, and combinations thereof. The method may further comprise providing a plurality of flow paths, wherein each individual flow path in the plurality of flow paths comprises a two-part dissolvable flow-plug, and wherein the retaining component in each individual flow path in the plurality of flow paths is at least partially dissolved prior to allowing a produced fluid circulating in the annulus between the tubing and the wellbore to push the plugging component of an individual flow path in the plurality of flow paths into the interior of the tubing.

Methods for plugging and unplugging a flow path are provided. An example method comprises providing a flow path comprising a two-part dissolvable flow-plug, wherein the flow path is coupled to a tubing disposed in a wellbore, and wherein the two-part dissolvable flow-plug comprises a plugging component and a retaining component; circulating a first solvent in the tubing to dissolve at least a portion of the retaining component; circulating a second solvent in the tubing to dissolve at least a portion of the plugging component; and allowing a produced fluid circulating in the annulus between the tubing and the wellbore to circulate in the interior of the tubing. The retaining component and the plugging component may comprise two dissolvable materials. The retaining component may be configured to retain the plugging component in a fixed position. The plugging component may comprise a dissolvable material different from the dissolvable material of the retaining component. The plugging component may be configured to hold the burst pressure of the flow path without the retaining component present. The dissolvable materials may comprise a dissolvable metal selected from the group consisting of magnesium, aluminum, zinc, iron, tin, copper, manganese, alloys thereof, and combinations thereof. The dissolvable materials may comprise a dissolvable polymer selected from the group consisting of polyglycolic acid, polylactic acid, thiol polymers, polyacrylate, polyurethane, polystyrene, poly(caprolactone), polyhydroxyalkonate, polyether ether ketone, neoprene, isoprene, butyl rubber, nitrile rubber, EPDM rubber, and combinations thereof. The dissolvable materials may be a hydrolytically degradable polymer. The dissolvable materials may be doped. The dissolvable materials may comprise a depassivating agent selected from the group consisting of gallium, indium, tin, and combinations thereof. The method may further comprise providing a plurality of flow paths, wherein each individual flow path in the plurality of flow paths comprises a two-part dissolvable flow-plug, and wherein the retaining component in each individual flow path in the plurality of flow paths is at least partially dissolved prior to allowing a produced fluid circulating in the annulus between the tubing and the wellbore to push the plugging component of an individual flow path in the plurality of flow paths into the interior of the tubing.

Therefore, the disclosed systems and methods are well adapted to attain the ends and advantages mentioned, as well as those that are inherent therein. The particular embodiments disclosed above are illustrative only, as the teachings of the present disclosure may be modified and practiced in different but equivalent manners apparent to those skilled in the art having the benefit of the teachings herein. Furthermore, no limitations are intended to the details of construction or design herein shown other than as described in the claims below. It is therefore evident that the particular illustrative embodiments disclosed above may be altered, combined, or modified, and all such variations are considered within the scope of the present disclosure. The systems and methods illustratively disclosed herein may suitably be practiced in the absence of any element that is not specifically disclosed herein and/or any optional element disclosed herein.

Although the present disclosure and its advantages have been described in detail, it should be understood that various changes, substitutions and alterations can be made herein without departing from the spirit and scope of the disclosure as defined by the following claims.

What is claimed is:

1. A well system in a subterranean formation, comprising:

a flow path comprising a two-part dissolvable flow-plug, the two-part dissolvable flow-plug comprising:

a retaining component, and a plugging component adjacent to the retaining component;

wherein the retaining component comprises a dissolvable material; wherein the flow path comprises a burst pressure; wherein the plugging component is configured to hold the burst pressure of the flow path without the retaining component present; and wherein the flow path is in fluid communication with a tubing.

2. The well system of claim 1, wherein the retaining component is configured to retain the plugging component in a fixed position.

3. The well system of claim 1, wherein the plugging component comprises a dissolvable material different from the dissolvable material of the retaining component.

4. The well system of claim 1, wherein the dissolvable material comprises a dissolvable metal selected from the group consisting of magnesium, aluminum, zinc, iron, tin, copper, manganese, alloys thereof, and combinations thereof.

5. The well system of claim 1, wherein the dissolvable material comprises a dissolvable polymer selected from the group consisting of polyglycolic acid, polylactic acid, thiol polymers, polyacrylate, polyurethane, polystyrene, poly (caprolactone), polyhydroxyalkonate, polyether ether ketone, neoprene, isoprene, butyl rubber, nitrile rubber, EPDM rubber, and combinations thereof.

6. The well system of claim 5, wherein the dissolvable material is a hydrolytically degradable polymer.

7. The well system of claim 1, wherein the dissolvable material is doped.

8. The well system of claim 1, wherein the dissolvable material comprises a depassivating agent selected from the group consisting of gallium, indium, tin, and combinations thereof.

9. The well system of claim 1, further comprising additional flow paths, wherein each additional flow path comprises a two-part dissolvable flow-plug.

10. A method for unplugging a flow path comprising a two-part dissolvable flow-plug, the method comprising:

providing the flow path comprising the two-part dissolvable flow-plug, wherein the flow path is coupled to a tubing disposed in a wellbore, and wherein the two-part dissolvable flow-plug comprises a plugging component and a retaining component; wherein the flow path comprises a burst pressure; wherein the plugging component is configured to hold the burst pressure of the flow path without the retaining component present;

circulating a solvent in the tubing to dissolve at least a portion of the retaining component; and allowing a produced fluid circulating in an annulus between the tubing and the wellbore to push the plugging component into the interior of the tubing.

11. The method of claim 10, wherein the retaining component and the plugging component comprise two dissolvable materials, wherein at least one of the two dissolvable materials comprises a dissolvable metal selected from the group consisting of magnesium, aluminum, zinc, iron, tin, copper, manganese, alloys thereof, and combinations thereof.

12. The method of claim 10, wherein the retaining component and the plugging component comprise two dissolvable materials, wherein at least one of the two dissolvable materials comprises a dissolvable polymer selected from the group consisting of polyglycolic acid, polylactic acid, thiol polymers, polyacrylate, polyurethane, polystyrene, poly (caprolactone), polyhydroxyalkonate, polyether ether ketone, neoprene, isoprene, butyl rubber, nitrile rubber, EPDM rubber, and combinations thereof.

13. The method of claim 10, wherein at least one of the retaining component or the plugging component comprises a depassivating agent selected from the group consisting of gallium, indium, tin, and combinations thereof.

14. The method of claim 10, further comprising additional flow paths, wherein each additional flow path comprises a two-part dissolvable flow-plug, and wherein the retaining component in each additional flow path is at least partially dissolved prior to allowing a produced fluid circulating in the annulus between the tubing and the wellbore to push the plugging component of an individual additional flow path into the interior of the tubing.

15. A method for unplugging a flow path comprising a two-part dissolvable flow-plug, the method comprising:

providing the flow path comprising the two-part dissolvable flow-plug, wherein the flow path is coupled to a tubing disposed in a wellbore, and wherein the two-part dissolvable flow-plug comprises a plugging component and a retaining component; wherein the flow path comprises a burst pressure; wherein the plugging component is configured to hold the burst pressure of the flow path without the retaining component present;

circulating a first solvent in the tubing to dissolve at least a portion of the retaining component;

circulating a second solvent in the tubing to dissolve at least a portion of the plugging component; and allowing a produced fluid circulating in an annulus between the tubing and the wellbore to circulate in the interior of the tubing.

16. The method of claim 15, wherein the retaining component and the plugging component comprise two dissolvable materials, wherein at least one of the two dissolvable materials comprises a dissolvable metal selected from the group consisting of magnesium, aluminum, zinc, iron, tin, copper, manganese, alloys thereof, and combinations thereof.

17. The method of claim 15, wherein the retaining component and the plugging component comprise two dissolvable materials, wherein at least one of the two dissolvable materials comprises a dissolvable polymer selected from the group consisting of polyglycolic acid, polylactic acid, thiol polymers, polyacrylate, polyurethane, polystyrene, poly (caprolactone), polyhydroxyalkonate, polyether ether ketone, neoprene, isoprene, butyl rubber, nitrile rubber, EPDM rubber, and combinations thereof.

18. The method of claim 15, wherein at least one of the retaining component or the plugging component comprises a depassivating agent selected from the group consisting of gallium, indium, tin, and combinations thereof.

19. The method of claim 16, further comprising additional flow paths, wherein each additional flow path comprises a two-part dissolvable flow-plug, and wherein the plugging component in each additional flow path is at least partially dissolved prior to allowing a produced fluid circulating in the annulus between the tubing and the wellbore to circulate in the interior of the tubing.

* * * * *